US009673581B1

(12) United States Patent
Chuang et al.

(10) Patent No.: US 9,673,581 B1
(45) Date of Patent: Jun. 6, 2017

(54) ELECTRICAL CONNECTOR

(71) Applicants: NICECONN TECHNOLOGY CO., LTD., New Taipei (TW); Yi-Fang Chuang, New Taipei (TW); Nai-Chien Chang, New Taipei (TW)

(72) Inventors: Yi-Fang Chuang, New Taipei (TW); Nai-Chien Chang, New Taipei (TW)

(73) Assignees: NICECONN TECHNOLOGY CO., LTD., New Taipei (TW); Yi-Fang Chuang, New Taipei (TW); Nai-Chien Chang, New Taipei (TW)

( * ) Notice: Subject to any disclaimer, the term of this patent is extended or adjusted under 35 U.S.C. 154(b) by 0 days.

(21) Appl. No.: 15/350,342

(22) Filed: Nov. 14, 2016

(30) Foreign Application Priority Data

Nov. 19, 2015 (TW) ..... 104218619 U

(51) Int. Cl.

| | |
|---|---|
| ***H01R 13/52*** | (2006.01) |
| ***H01R 24/64*** | (2011.01) |
| ***H01R 31/06*** | (2006.01) |
| *H01R 107/00* | (2006.01) |

(52) U.S. Cl.
CPC ..... *H01R 24/64* (2013.01); *H01R 31/06* (2013.01); *H01R 2107/00* (2013.01)

(58) Field of Classification Search
CPC H01R 13/5219; H01R 13/52; H01R 13/5205; H01R 13/622; H01R 13/521
USPC ..... 439/271, 275, 278, 277, 589
See application file for complete search history.

(56) References Cited

U.S. PATENT DOCUMENTS

| | | | | |
|---|---|---|---|---|
| 6,688,911 | B2 * | 2/2004 | Fuerst | H01R 12/87 439/496 |
| 7,749,012 | B2 * | 7/2010 | Morello | H01R 13/5208 264/250 |
| 8,123,550 | B2 * | 2/2012 | Hoshino | H01R 13/641 439/260 |
| 8,337,227 | B2 * | 12/2012 | Arai | H01B 7/285 439/271 |
| 2009/0042433 | A1 * | 2/2009 | Bushby | H01R 13/4538 439/352 |
| 2013/0288516 | A1 * | 10/2013 | Chang | H01R 13/465 439/488 |

* cited by examiner

*Primary Examiner* — Phuongchi T Nguyen
(74) *Attorney, Agent, or Firm* — Chun-Ming Shih; HDLS IPR Services

(57) ABSTRACT

An electrical connector comprising an insulating housing, a USB Type-C connector arranged in the insulating housing, a circuit board and a plurality of transferring terminals is disclosed. One side of the circuit board is connected with twenty-four connection terminals of the USB Type-C connector, other side of the circuit board is connected with the plurality of transferring terminals which are corresponding to USB Type-A standard. The circuit board is arranged with a connecting line, which is used to integrate signal transmitted through the twenty-four connection terminals of the USB Type-C connector into USB Type-A standard adopted outputting signal, and outputs the outputting signal through the plurality of transferring terminals.

9 Claims, 5 Drawing Sheets

ELECTRICAL CONNECTOR

BACKGROUND OF THE INVENTION

1. Technical Field

The present invention relates to a connector, and in particular to an improved electrical connector.

2. Description of Prior Art

Due to the development of the electronics industry, many types of electronic devices are now popular and surrounding people's life. In order to transmit control commands, multimedia data and power, most electronic devices are arranged with at least one electrical connector.

The most popular electrical connector in the market is universal serial bus (USB) connector. General speaking, the most popular USB connector is USB Type-A connector. Besides, USB Micro-B connector is another USB interface which is smaller than USB Type-A connector, and is mostly adopted in portable devices such as smart phones, tablets, etc. Furthermore, USB Implementers Forum announced USB Type-C interface for USB 3.1 standard, which is made for slighter, thinner devices.

A skilled person in the technical field may know the amount of the terminals in a USB 3.0 Type-A connector is nine, the amount of the terminals in a USB 2.0 Type-A connector is four, and the amount of the terminals in a USB 3.1 Type-C connector is twenty-four. As a result, if a computer needs to use a USB 3.1 Type-C connector, the pin definition of the mainboard of the computer needs to be changed following the USB 3.1 Type-C standard (for example, traditional nine pins or four pins of the mainboard needs to be changed into twenty-four pins). Besides, the circuit design of the mainboard also needs to be extremely adjusted. Therefore, the cost of development and manufacture of the mainboard will be increased.

SUMMARY OF THE INVENTION

The present invention is to provide an electrical connector, which may connect with a mainboard through inserting holes adopted with USB Type-A standard and make the mainboard to use a USB Type-C connector of the electrical connector.

In one of the exemplary embodiments, the electrical connector comprises an insulating housing, a USB Type-C connector arranged in the insulating housing, a circuit board and a plurality of transferring terminals. One side of the circuit board is connected with twenty-four connection terminals of the USB Type-C connector, other side of the circuit board is connected with the plurality of transferring terminals which are corresponding to USB Type-A standard. The circuit board is arranged with a connecting line which is used to integrate signal transmitted through the twenty-four connection terminals of the USB Type-C connector into USB Type-A standard adopted outputting signal, and outputs the outputting signal through the plurality of transferring terminals.

In comparison with prior art, the electrical connector of the present invention may connect with an external mainboard through USB Type-A adopted inserting holes, so as to connect with the mainboard and make the mainboard to use the USB Type-C connector on the electrical connector without changing the circuit arrangement of the mainboard, which is very convenient.

DETAILED DESCRIPTION OF THE INVENTION

In cooperation with the attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
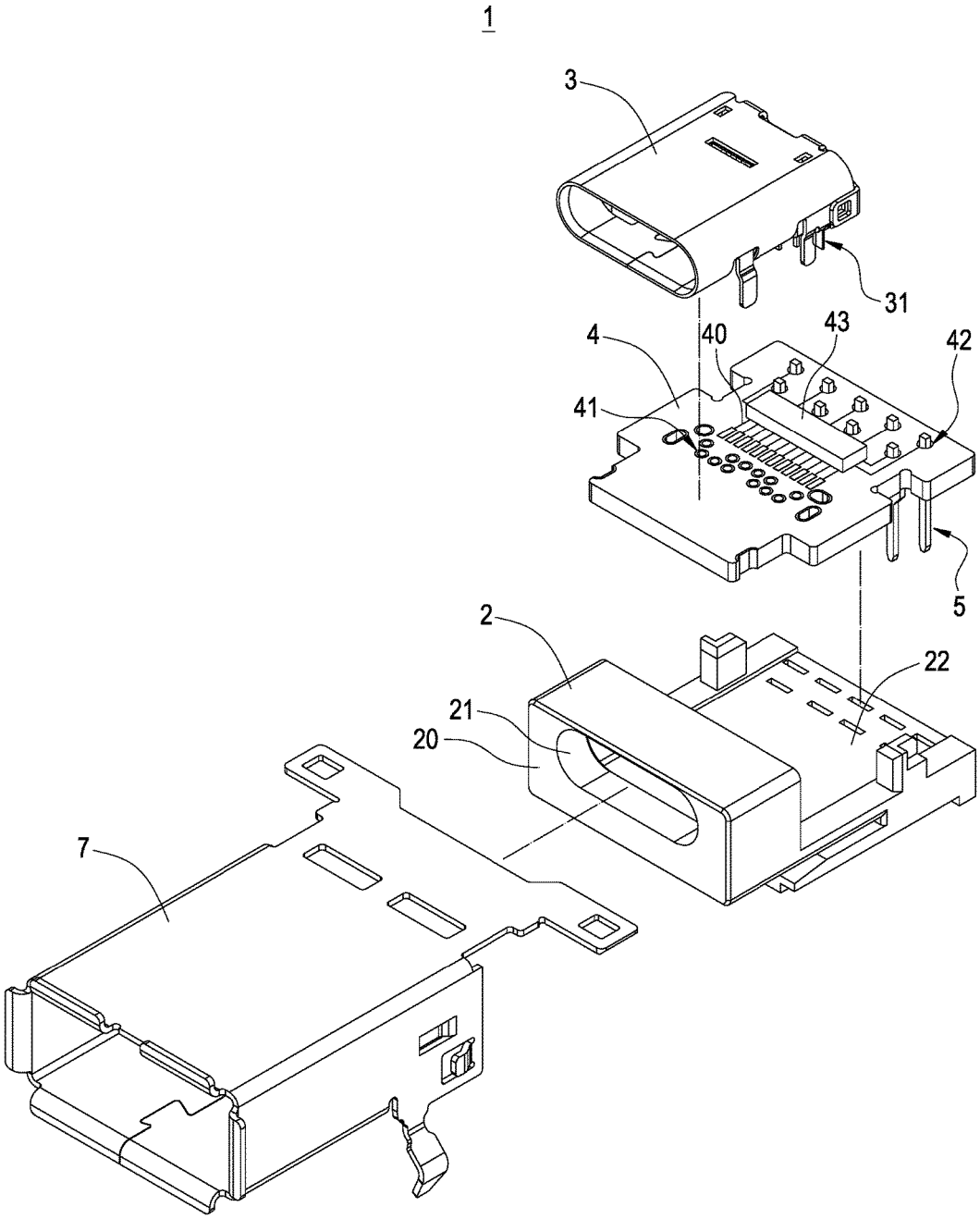
FIG. 1 is a perspective view of a first embodiment according to the present invention.
Figure 2:
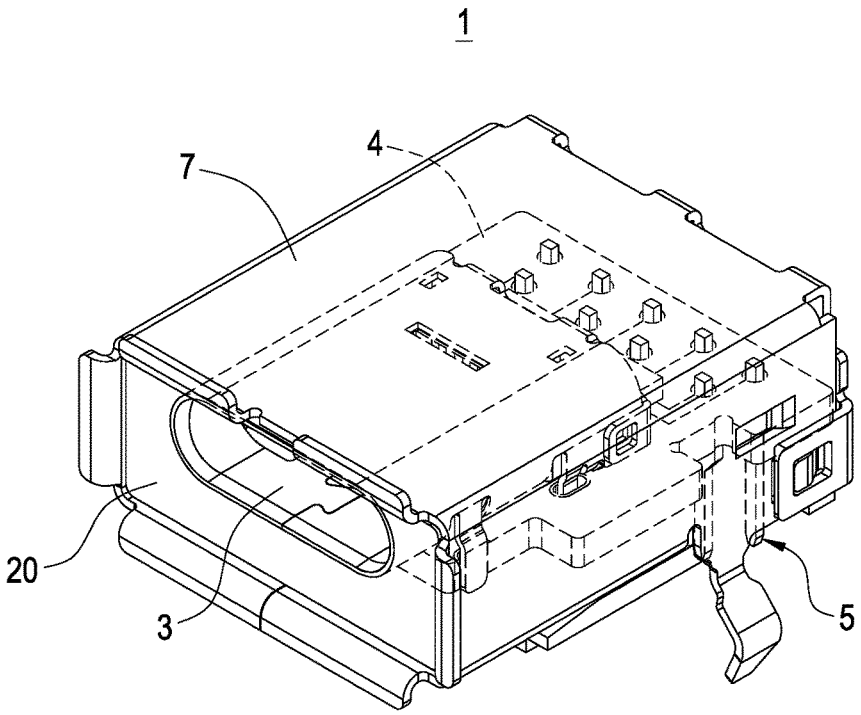
FIG. 2 is a schematic view of a first embodiment according to the present invention.
Figure 3:
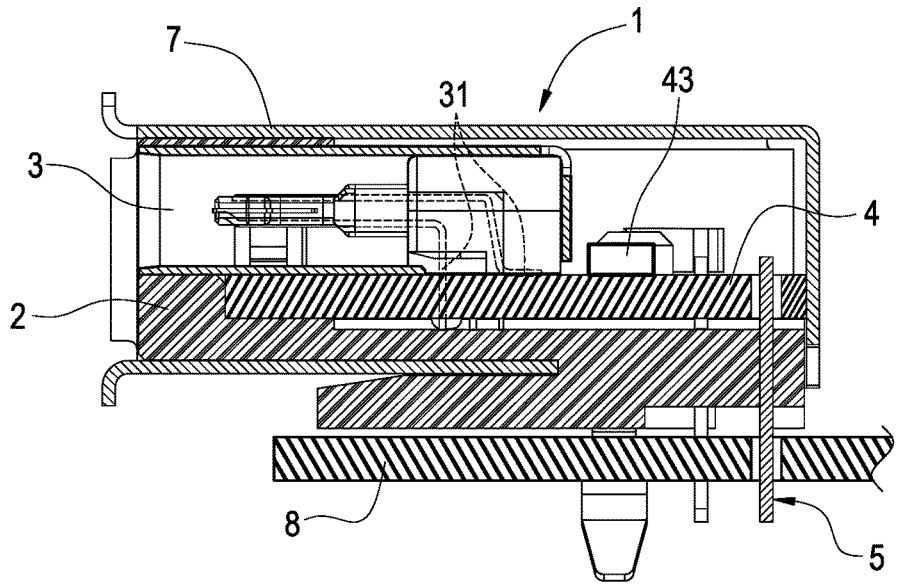
FIG. 3 is a side view of a first embodiment according to the present invention.

Please refer to FIG. 1, FIG. 2 and FIG. 3, which are respectively a perspective view, a schematic view and a side view of a first embodiment according to the present invention. As shown in the figures, the present invention discloses an improved electrical connector (refers to as the connector assembly 1 hereinafter), the connector assembly 1 comprises an insulating housing 2, a USB Type-C connector 3, a circuit board 4, and a plurality of transferring terminals 5.

In one aspect, the USB Type-C connector 3 is a USB 3.1 Type-C connector, which comprises a plurality of connection terminals 31. In one embodiment, an amount of the plurality of connection terminals 31 is twenty-four.

In one embodiment shown in FIG. 1 and FIG. 2, the USB Type-C connector 3 and the circuit board 4 are horizontally arranged in the insulating housing 2. More specific, the insulating housing 2 is arranged with a connector container 21 inside the insulating housing 2. In one aspect, the USB Type-C connector 3 is arranged horizontally in the connector container 21, the circuit board 4 is arranged approximately to the USB Type-C connector 3. In one embodiment, the circuit board 4 is horizontally arranged below the USB Type-C connector 3.

More specific, the insulating housing 2 is internally arranged with a circuit board container 22 which communicates with the connector container 21, and the circuit board 4 is horizontally arranged in the circuit board container 22. In one embodiment, the circuit board container 22 is arranged below the connector container 21.

As shown in FIG. 1, the insulating housing 2 has a front face 20, the USB Type-C connector 3 is arranged in the connector container 21 and exposed out of the front face 20. In one aspect, the size and the shape of the front face 20 are the same as that of a front face of a standard USB Type-A connector. Therefore, the connector assembly 1 may be easily substituted for a USB Type-A connector with standard size and shape, and may be easily arranged in a composite connector without changing the current structure of the composite connector, which is very convenient.

The connector assembly 1 further comprises the plurality of transferring terminals 5. One end of the circuit board 4 is electrically connected with the plurality of connection terminals 31 of the USB Type-C connector 3, the other end of the circuit board 4 is electrically connected with the plurality of transferring terminals 5. The plurality of transferring terminals 5 is corresponding to USB Type-A standard. In one embodiment, the amount of the plurality of transferring terminals 5 may be nine, which is corresponding to the amount of terminals in a USB 3.0 Type-A connector. In other embodiment, the amount of the plurality of transferring terminals 5 may be four, which is corresponding to the amount of terminals in a USB 2.0 Type-A connector, not limited thereto. One end of the plurality of transferring terminals 5 is electrically connected with the circuit board 4, other end of the plurality of transferring terminals is protruding from the bottom of the insulating housing, so as to connect with an external mainboard 8.

The connector assembly 1 further comprises a connecting line 40. The connecting line 40 is arranged on the circuit board 4, so as to electrically connect with the plurality of connection terminals 31 of the USB Type-C connector 3 and the plurality of transferring terminals 5 through the circuit board 4. In particular, the circuit board 4 is arranged with a plurality of first contacts 41 and a plurality of second contacts 42. The connecting line 40 is connected with both the plurality of first contacts 41 and the plurality of second contact 42, so as to connect with the plurality of connection terminals 31 of the USB Type-C connector 3 through the plurality of first contacts 41, and to connect with the plurality of transferring terminals 5 through the plurality of second contacts 42. In other words, the plurality of transferring terminals 5 is to connect with the USB Type-C connector 3 through the circuit board 4, the plurality of second contacts 42, the connecting line 40, the plurality of first contacts 41 and the plurality of connection terminals 31.

In one embodiment, the connecting line 40 is used to integrate the signal transmitted by the USB Type-C connector 3 through the plurality of connection terminals 31 into USB Type-A standard adopted outputting signal, and transmits the integrated outputting signal externally through the plurality of transferring terminals 5. Also, the connecting line 40 receives USB Type-A standard adopted input signal externally through the plurality of transferring terminals 5, and processes the received input signal to be transmitted by the plurality of connection terminals 31, then transmits it externally through the USB Type-C connector 3. In this embodiment, the aforementioned integrated procedure is to perform a parallel connection to same signal, but not limited thereto.

As shown in FIG. 1, the amount of the plurality of first contacts 41 is corresponding to that of the plurality of connection terminals 31, which may be twenty-four. The amount of the plurality of second contacts 42 is corresponding to that of the plurality of transferring terminals 5, which may be nine in one embodiment. In other embodiment, the amount of the plurality of second contacts 42 and the plurality of transferring terminals 5 may be four, but not limited thereto.

The connector assembly 1 further comprises a processing unit 43, electrically connected on the circuit board 4, and electrically connected with the USB Type-C connector 3 and the plurality of transferring terminals 5 through the connecting line 40. In this embodiment, the processing unit 43 may be any type of protecting component for providing the safety of the connector assembly 1 during signal transmission.

In one embodiment, the connector assembly 1 further comprises a shielding 7, the shielding 7 is used to cover the insulating housing 2, the USB Type-C connector 3, the circuit board 4 and the plurality of transferring terminals 5, so as to provide shielding effect.

Figure 4:
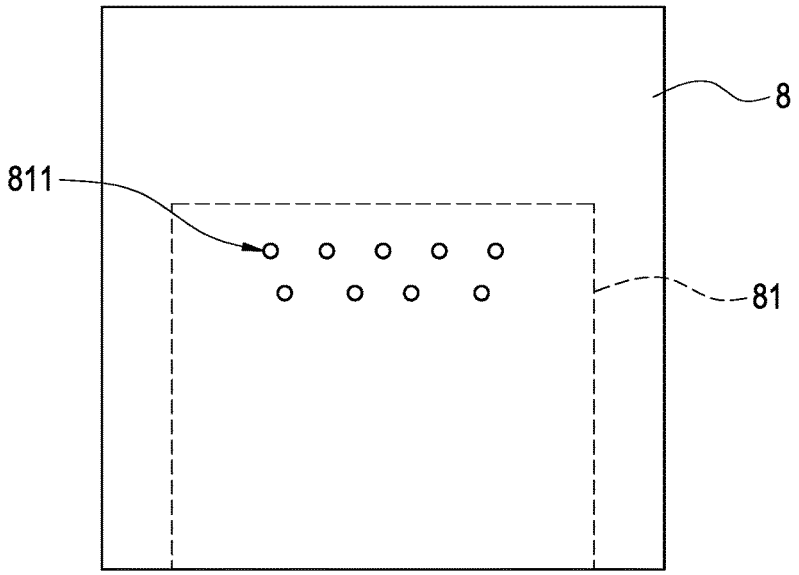
FIG. 4 is a schematic diagram showing mainboard inserting holes of a first embodiment according to the present invention.

Refers to FIG. 4, FIG. 4 is a schematic diagram showing mainboard inserting holes of a first embodiment according to the present invention. An embodiment shown in FIG. 4 discloses a mainboard 8 adopted by an external computer apparatus (not shown). The mainboard 8 comprises a connecting area 81, and the connecting area 81 comprises an inserting hole set 811. In one embodiment, the inserting hole set 811 comprises nine inserting holes.

The connecting area 81 is used to connect with a standard USB 3.0 Type-A connector. The nine connecting terminals of the USB 3.0 Type-A connector are respectively corresponding to the nine inserting holes of the inserting hole set 811.

In one aspect of the invention, the circuit board 4, the connecting line 40 and the plurality of transferring terminals 5 are used to integrate the plurality of connection terminals 31 of the USB Type-C connector 3 into an amount that is less than twenty-four and meets the amount of a standard USB Type-A connector (the amount in the embodiment shown in FIG. 1 is nine for example). Therefore, the connector assembly 1 disclosed in each embodiment of the present invention may be directly connected to the connecting area 81 of the mainboard 8, i.e., the mainboard 8 doesn't need to change its pin definition and circuit design and it may directly connect with the connector assembly 1 of the present invention for using the USB Type-C connector 3 of the connector assembly 1, so as to reduce additional cost of development and manufacture.

Figure 5:
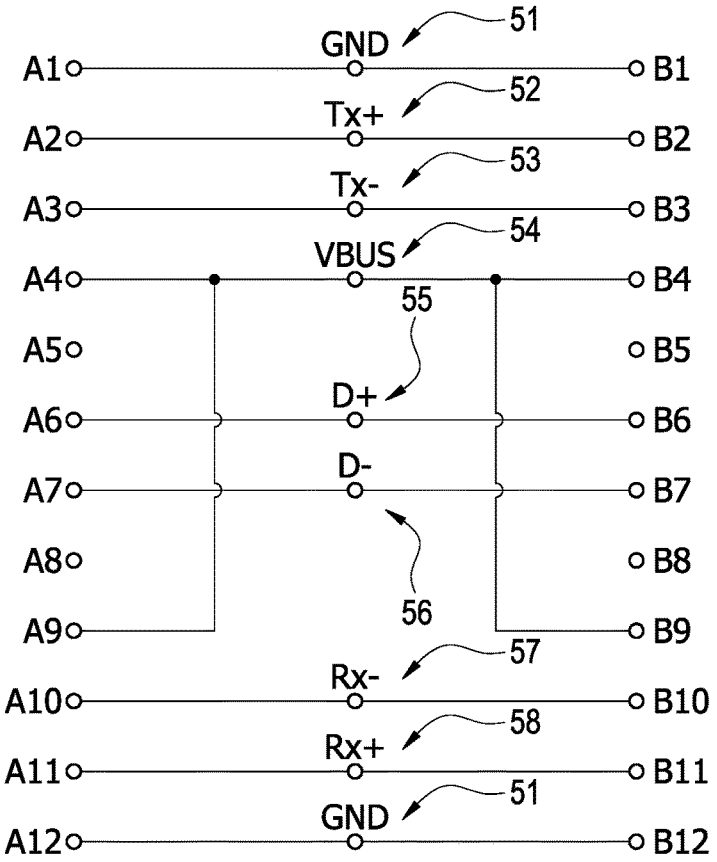
FIG. 5 is a schematic diagram showing circuit connection of a first embodiment according to the present invention.

FIG. 5 is a schematic diagram showing circuit connection of a first embodiment according to the present invention. The embodiment shown in FIG. 5 discloses how the circuit board 4 and the connecting line 40 integrate the plurality of connection terminals 31 (for example, twenty-four terminals) of the USB Type-C connector 3 into the nine transferring terminals 5 that is corresponding to USB 3.0 Type-A standard. The standard pin definition of the USB Type-C connector 3 is described as the following table:

| A1 | A2 | A3 | A4 | A5 | A6 | A7 | A8 | A9 | A10 | A11 | A12 |
|---|---|---|---|---|---|---|---|---|---|---|---|
| GND | Tx1+ | Tx1− | VBUS | CC1 | D+ | D− | SBU1 | VBUS | Rx2− | Rx2+ | GND |
| B12 | B11 | B10 | B9 | B8 | B7 | B6 | B5 | B4 | B3 | B2 | B1 |
| GND | Rx1+ | Rx1− | VBUS | SBU2 | D− | D+ | CC2 | VBUS | Tx2− | Tx2+ | GND |

The above table shows the well-known terminal standard of USB Type-C connector, no more discussion is needed here. A1 to A12 of the above table indicates the terminal definition of the twelve connection terminals 31 of top of the USB Type-C connector 3, B1 to B12 of the above table indicates the terminal definition of the twelve connection terminals 31 of bottom of the USB Type-C connector 3, wherein, GND indicates a grounding terminal, Tx1+ and Tx2+ indicate positive transmitting terminals, Tx1− and Tx2− indicate negative transmitting terminals, VBUS indicates a power terminal, D+ indicates a positive data terminal, D− indicates a negative data terminal, Rx1+ and Rx2+ indicate positive receiving terminals, Rx1− and Rx2− indicate negative receiving terminals. Furthermore, CC1, CC2, SBU1 AND SBU2 are irrelated with the exemplary embodiments of the present invention, no more discussion is needed here.

In one of the exemplary embodiments, the nine transferring terminals 5 comprise two grounding terminals 51 (GND), a positive transmitting terminal 52 (Tx+), a negative transmitting terminal 53 (Tx−), a power terminal 54 (VBUS), a positive data terminal 55 (D+), a negative data terminal 56 (D−), a negative receiving terminal 57 (Rx−) and a positive receiving terminal 58 (Rx+).

As shown in FIG. 5, among the nine transferring terminals 5, the two grounding terminals 51 are respectively connected with the first terminal and the twelfth terminal (A1, A12) from the top and the first terminal and the twelfth terminal (B1, B12) from the bottom of the USB Type-C connector 3; the positive transmitting terminal 52 is connected with both the second terminal (A2) from the top and the second terminal (B2) from the bottom of the USB Type-C connector 3; the negative transmitting terminal 53 is connected with both the third terminal (A3) from the top and the third terminal (B3) from the bottom of the USB Type-C connector 3; the power terminal 54 is connected with the fourth terminal and the ninth terminal (A4, A9) from the top and the fourth terminal and the ninth terminal (B4, B9) from the bottom of the USB Type-C connector 3; the positive data terminal 55 is connected with both the sixth terminal (A6) from the top and the sixth terminal (B6) from the bottom of the USB Type-C connector 3; the negative data terminal 56 is connected with both the seventh terminal (A7) from the top and the seventh terminal (B7) from the bottom of the USB Type-C connector 3; the negative receiving terminal 57 is connected with both the tenth terminal (A10) from the top and the tenth terminal (B10) from the bottom of the USB Type-C connector 3; the positive receiving terminal 58 is connected with both the eleventh terminal (A11) from the top and the eleventh terminal (B11) from the bottom of the USB Type-C connector 3.

According to the aforementioned configuration, the mainboard 8 may connect with the connector assembly 1 through pins corresponding to USB 3.0 Type-A standard. No matter a connector plug (not shown) inserted into the USB Type-C connector 3 is obverse or reverse, the mainboard 8 may establish a communication with an electronic device (not shown) connected with the connector plug through the USB Type-C connector 3. However, in the embodiments of the present invention, the signal transmitted by the USB Type-C connector 3 may be as similar as the signal transmitted through standard USB 3.0 Type-A connectors.

Figure 6:
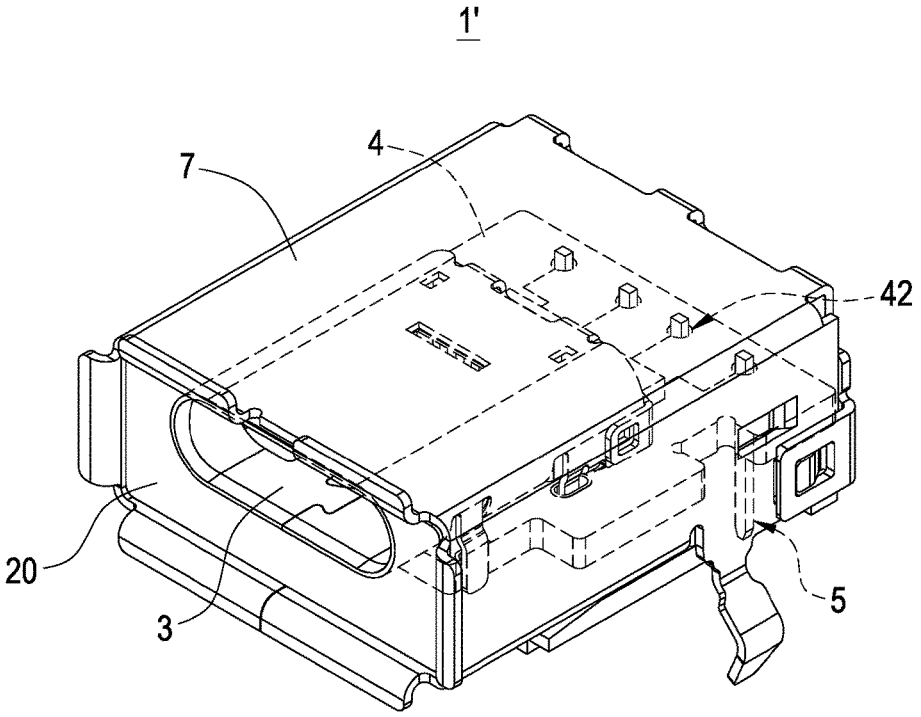
FIG. 6 is a schematic view of a second embodiment according to the present invention.

FIG. 6 is a schematic view of a second embodiment according to the present invention. One of the exemplary embodiments shown in FIG. 6 discloses other connector assembly 1'. The connector assembly 1' comprises multiple components as similar as the aforementioned connector assembly 1, such as the insulating housing 2, the USB Type-C connector 3, the circuit board 4, the plurality of transferring terminals 5 and the shielding 7. The difference between the connector assembly 1' and the aforementioned c connector assembly 1 is that the plurality of transferring terminals 5 of the connector assembly 1' is corresponding to USB 2.0 Type-A standard, the amount of the plurality of transferring terminals 5 of the connector assembly 1' may be four, which is corresponding to the amount of the terminals in a standard USB 2.0 Type-A connector. In this embodiment, the amount of the plurality of second contacts may be four either.

Figure 7:
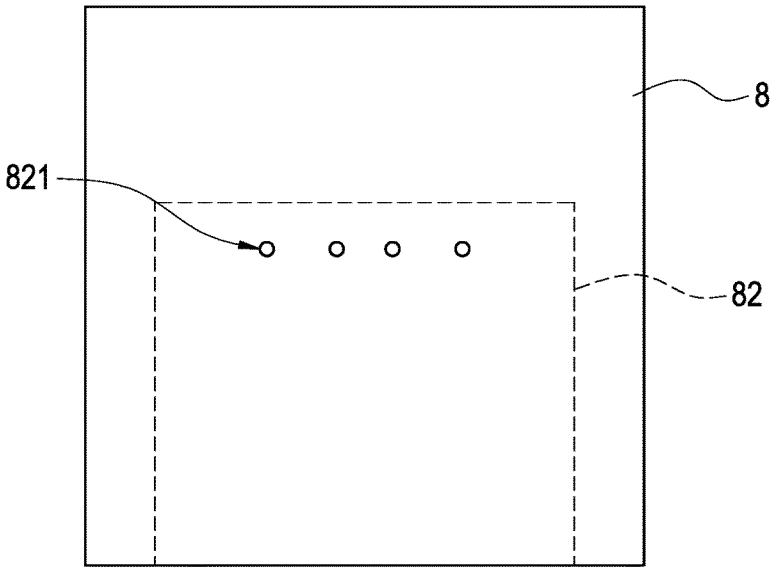
FIG. 7 is a schematic diagram showing mainboard inserting holes of a second embodiment according to the present invention.

FIG. 7 is a schematic diagram showing mainboard inserting holes of a second embodiment according to the present invention. One of the exemplary embodiments shown in FIG. 7 discloses other connecting area 82 on the mainboard 8, the connecting area 82 comprises an inserting hole set 821, and the inserting hole set 821 comprises four inserting holes.

In particular, the connecting area 82 is used to connect a standard USB 2.0 Type-A connector, wherein the four terminals of the USB 2.0 Type-A connector are respectively corresponding to the four inserting holes of the inserting hole set 821.

As mentioned above, in order to connect with the connecting area 82 of the mainboard 8, the connector assembly 1' needs to integrate the plurality of connection terminals 31 of the USB Type-C connector 3 into four outputting terminals which satisfies USB 2.0 Type-A standard (i.e., the amount of the plurality of transferring terminals 5 of the connector assembly 1' is four).

Figure 8:
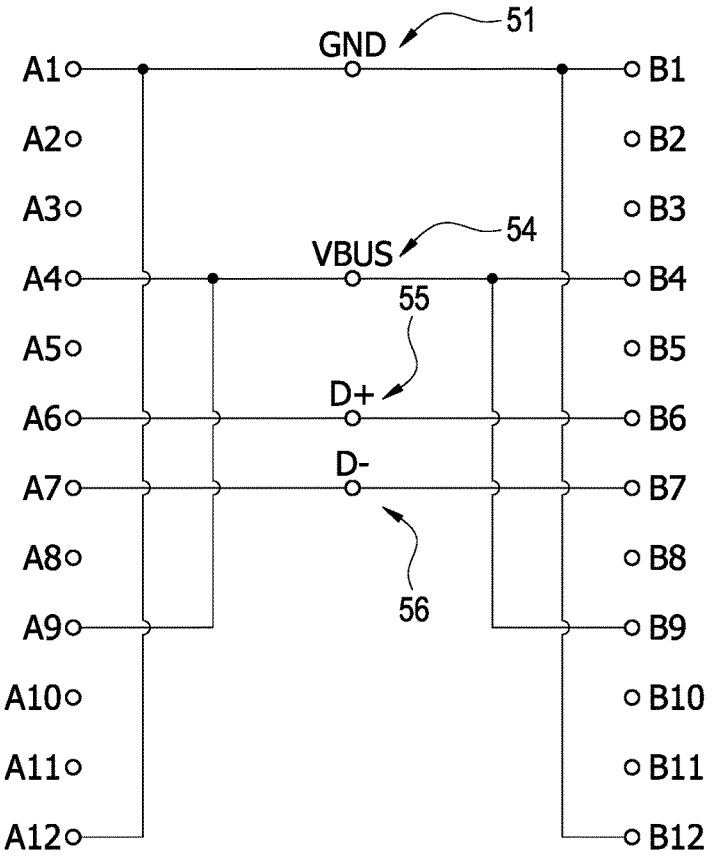
FIG. 8 is a schematic diagram showing circuit connection of a second embodiment according to the present invention.

FIG. 8 is a schematic diagram showing circuit connection of a second embodiment according to the present invention. In one of the exemplary embodiments shown in FIG. 8, the amount of the plurality of transferring terminals 5 of the connector assembly 1' may be four, and the four transferring terminals 5 comprise the grounding terminal 51, the power terminal 54, the positive data terminal 55 and the negative data terminal 56. In this embodiment, the grounding terminal 51 is connected with the first terminal and the twelfth terminal (A1, A12) from the top and the first terminal and the twelfth terminal (B1, B12) from the bottom of the USB Type-C connector 3; the power terminal 54 is connected with the fourth terminal and the ninth terminal (A4, A9) from the top and the fourth terminal and the ninth terminal (B4, B9) from the bottom of the USB Type-C connector 3; the positive data terminal 55 is connected with both the sixth terminal (A6) from the top and the sixth terminal (B6) from the bottom of the USB Type-C connector 3; the negative data terminal 56 is connected with both the seventh terminal (A7) from the top and the seventh terminal (B7) from the bottom of the USB Type-C connector 3.

It should be mentioned that the second terminal, the third terminal, the fifth terminal, the eighth terminal, the tenth terminal, the eleventh terminal (A2, A3, A5, A8, A10, A11) from the top and the second terminal, the third terminal, the fifth terminal, the eighth terminal, the tenth terminal, the eleventh terminal (B2, B3, B5, B8, B10, B11) from the bottom of the USB Type-C connector 3 are irrelated to USB 2.0 Type-A standard, it results in that the aforementioned terminals may not be connected with the plurality of transferring terminals 5 in the embodiment.

According to the disclosed embodiments of the present invention, the mainboard 8 may directly connect with the connector assembly 1 or 1' through the current existed USB 2.0 Type-A standard adopted pins and/or USB 3.0 Type-A standard adopted pins, so as to use the USB Type-C connector 3 of the connector assembly 1 or 1', which is very convenient.

As the skilled person will appreciate, various changes and modifications can be made to the described embodiment. It is intended to include all such variations, modifications and equivalents which fall within the scope of the present invention, as defined in the accompanying claims.

What is claimed is:

1. A connector assembly, comprising:

an insulating housing, comprising a connector container and a front face, and size and shape of the front face are corresponding to size and shape of a port of a standard USB Type-A connector;

a USB Type-C connector, horizontally arranged in the connector container and exposed out of the front face, arranged in the insulating housing and the USB Type-C connector comprising a plurality of connection terminals;

a plurality of transferring terminals, corresponding to USB Type-A standard;

a circuit board, horizontally arranged below the USB Type-C connector, one end of the circuit board being electrically connected with the plurality of transferring terminals, the other end of the circuit board being electrically connected with the plurality of connection terminals; and a connecting line, arranged on the circuit board and electrically connected with the plurality of connection terminals and the plurality of transferring terminals, the connecting line integrating signal transmitted by the USB Type-C connector through the plurality of connection terminals into USB Type-A standard adopted outputting signal and transmitting the outputting signal externally through the plurality of transferring terminals;

wherein an amount of the plurality of transferring terminals is nine, and the nine transferring terminals comprise a power terminal (VBUS), a positive data terminal (D+), a negative data terminal (D−), a positive transmitting terminal (Tx+), a negative transmitting terminal (Tx−), a positive receiving terminal (Rx+), a negative receiving terminal (Rx−), and two grounding terminals (GND).

2. The connector assembly in claim 1, further comprising a processing unit, electrically connected with the circuit board, and electrically connected with the plurality of transferring terminals and the plurality of connection terminals through the connecting line.

3. The connector assembly in claim 1, wherein an amount of the plurality of connection terminals is twenty-four.

4. The connector assembly in claim 3, wherein the circuit board comprises a plurality of first contacts and a plurality of second contacts, the connecting line is connected with the plurality of first contacts and the plurality of second contacts, and the connecting line is connected with the plurality of connection terminals through the plurality of first contacts and connected with the plurality of transferring terminals through the plurality of second contacts.

5. The connector assembly in claim 4, wherein the insulating housing comprises a circuit board container which communicates with connector container, the circuit board is horizontally arranged in the circuit board container, wherein the circuit board container is arranged below the connector container.

6. The connector assembly in claim 4, wherein the plurality of transferring terminals are respectively connected with the USB Type-C connector through the circuit board and the connecting line, wherein the power terminal is connected with a fourth terminal and a ninth terminal from a top and a fourth terminal and a ninth terminal from a bottom of the USB Type-C connector, the positive data terminal is connected with a sixth terminal from the top and a sixth terminal from the bottom of the USB Type-C connector, the negative data terminal is connected with a seventh terminal from the top and a seventh terminal from the bottom of the USB Type-C connector, the positive transmitting terminal is connected with a second terminal from the top and a second terminal from the bottom of the USB Type-C connector, the negative transmitting terminal is connected with a third terminal from the top and a third terminal from the bottom of the USB Type-C connector, the positive receiving terminal is connected with an eleventh terminal from the top and an eleventh terminal from the bottom of the USB Type-C connector, the negative receiving terminal is connected with a tenth terminal from the top and a tenth terminal from the bottom of the USB Type-C connector, and the two grounding terminals are respectively connected with a first terminal and a twelfth terminal from the top and a first terminal and a twelfth terminal from the bottom of the USB Type-C connector.

7. A connector assembly, comprising:

an insulating housing, comprising a connector container and a front face, and size and shape of the front face are corresponding to size and shape of a port of a standard USB Type-A connector;

a USB Type-C connector, horizontally arranged in the connector container and exposed out of the front face, and the USB Type-C connector comprising a plurality of connection terminals;

a plurality of transferring terminals, corresponding to USB Type-A standard;

a circuit board, horizontally arranged below the USB Type-C connector, one end of the circuit board being electrically connected with the plurality of transferring terminals, the other end of the circuit board being electrically connected with the plurality of connection terminals; and a connecting line, arranged on the circuit board and electrically connected with the plurality of connection terminals and the plurality of transferring terminals, the connecting line integrating signal transmitted by the USB Type-C connector through the plurality of connection terminals into USB Type-A standard adopted outputting signal and transmitting the outputting signal externally through the plurality of transferring terminals;

wherein an amount of the plurality of transferring terminals is four, and the four transferring terminals comprise a power terminal (VBUS), a positive data terminal (D+), a negative data terminal (D−), and a grounding terminal (GND).

8. The connector assembly in claim 7, wherein the plurality of transferring terminals are respectively connected with the USB Type-C connector through the circuit board and the connecting line, wherein the power terminal is connected with a fourth terminal and a ninth terminal from a top and a fourth terminal and a ninth terminal from a bottom of the USB Type-C connector, the positive data terminal is connected with a sixth terminal from the top and a sixth terminal from the bottom of the USB Type-C connector, the negative data terminal is connected with a seventh terminal from the top and a seventh terminal from the bottom of the USB Type-C connector, and the grounding terminal is connected with a first terminal and a twelfth terminal from the top and a first terminal and a twelfth terminal from the bottom of the USB Type-C connector.

9. The connector assembly in claim 7, further comprising a processing unit, electrically connected with the circuit board, and electrically connected with the plurality of transferring terminals and the plurality of connection terminals through the connecting line.

* * * * *